US005970941A

United States Patent [19]

Bock

[11] Patent Number: 5,970,941

[45] Date of Patent: Oct. 26, 1999

[54] CYLINDER LINER CONNECTING ARRANGEMENT AND METHOD

[75] Inventor: Allyn P. Bock, West Lafayette, Ind.

[73] Assignee: Caterpillar Inc., Peoria, Ill.

[21] Appl. No.: 09/097,629

[22] Filed: Jun. 16, 1998

[51] Int. Cl.[6] ..... F02F 1/00

[52] U.S. Cl. ..... 123/193.3

[58] Field of Search ..... 123/193.5, 193.3, 123/193.2

[56] References Cited

U.S. PATENT DOCUMENTS

| | | | |
|---|---|---|---|
| 1,314,352 | 8/1919 | Morin | 123/193.3 |
| 1,825,769 | 10/1931 | Barbarou | 123/193.3 |
| 1,857,077 | 5/1932 | Adamson . | |
| 1,951,948 | 3/1934 | Pobjoy . | |
| 2,144,928 | 1/1939 | Moncrieff . | |
| 2,415,155 | 2/1947 | Wyatt . | |
| 2,560,700 | 7/1951 | Pervier . | |
| 2,736,300 | 2/1956 | Flynn | 123/193.3 |
| 3,685,399 | 8/1972 | Hoch . | |
| 4,542,719 | 9/1985 | Wilkinson . | |
| 4,562,799 | 1/1986 | Woods et al. . | |
| 4,763,619 | 8/1988 | Eitel . | |
| 5,095,868 | 3/1992 | Brighigna | 123/193.3 |
| 5,768,780 | 6/1998 | Hobson et al. | 123/193.3 |

*Primary Examiner*—Marguerite McMahon
*Attorney, Agent, or Firm*—Alan J. Hickman

[57] ABSTRACT

A cylinder liner for an internal combustion engine is externally threaded at a first end portion. An annular groove having a threaded first side surface is disposed in a cylinder head. The cylinder liner is screwthreadably engaged with threaded annular groove, forcibly engaged with an end surface of the annular groove, and sealed by side thread loading. A seal member and ring disposed about the cylinder liner and in a coolant passage isolates the threads from coolant fluid and optimizes cylinder liner cooling. A minimum crevice volume is provided between the annular groove and the cylinder liner.

20 Claims, 3 Drawing Sheets

CYLINDER LINER CONNECTING ARRANGEMENT AND METHOD

TECHNICAL FIELD

This invention relates generally to a connecting arrangement and method for a cylinder liner assembly and more particularly to a threaded cylinder liner and threaded cylinder head connection and method.

BACKGROUND ART

Over the decades diesel and gas engines have evolved with basically three different types cylinder block and liner configurations. The integral bore cylinder block, top flanged liner and spacer plate and block combination and the mid supported liner spacer deck block arrangement.

The integral bore cylinder block is generally used for engines where cost, weight and size are the driving force behind the design and durability, and reparability is secondary. This type engine is generally considered light to medium duty.

The top flanged liner and cylinder block have been the industry standard for heavy duty diesel engines for decades. Top flanged liners are hardened for long life goals and easy reparability in case of cylinder bore damage. The engines can be rebuilt to like new at major overhaul by installing new liners.

The mid supported cylinder liner has the features of the conventional flanged liner and in addition permits the cooling fluid level to be raised to the top of the cylinder liner. The advantage for this system is the ability to raise the top ring of the piston to near the top of the piston thus reducing crevice volume in the combustion area. Crevice volume is a factor in lowering fuel consumption and emissions.

Although many of the major deficiencies associated with engine cylinders have been addressed they all fall short of maximization. In this regard, there is left the need for improvement in the areas of emissions by further reducing crevice volume. Crevice volume can be further reduced by maximizing the height of liner cooling to the bottom of the cylinder head. This would allow the piston rings to be placed closer to the cylinder head which reduces crevice volume. Also, by the elimination of clamping on the cylinder liner flange as in the mid or top mounted cylinder liners, undesirable emissions may be reduced. Clamping causes cylinder liner distortion. Without clamping, cylinder bore roundness may be maintained. Cylinder roundness facilitates good piston ring sealing which contributes to a reduction in undesirable engine emissions.

The present invention is directed to overcoming one or more of the problems as set forth above.

DISCLOSURE OF THE INVENTION

In one aspect of the present invention, a connecting arrangement for a cylinder liner of and internal combustion engine is provided. The cylinder liner has an outer surface, an inner surface, first and second spaced end portions and a first end located at the first end portion. A screw thread is disposed in and about the outer surface of the first end portion of the cylinder liner and terminates at the first end. A cylinder head having a supporting surface and an annular groove disposed in the cylinder head opens at the supporting surface. The annular groove is defined by a first side surface, a second side surface spaced from said first side surface and an end surface. The first side surface has a screw thread disposed therein which terminates at the supporting surface of said cylinder head. The first end portion of the cylinder liner is disposed in the annular groove. The screw threads of the cylinder liner are screwthreadably engaged with the screw threads in the cylinder head. The end of the cylinder liner is forcibly engaged with the end surface of the annular groove.

In another aspect of the present invention, a method of assembling a cylinder liner in an engine block, comprises the steps of: screw threading a cylinder liner having a threaded outer surface first end portion into threaded engagement with a threaded annular groove disposed in a cylinder head; tightening the cylinder liner until an end of the cylinder liner is forcibly engaged with an end surface of the annular groove and the threads are side loaded; placing the cylinder liner in a cylinder liner receiving bore disposed in an engine block; and supporting a supporting surface of the cylinder head on a supporting surface of the engine block.

BEST MODE FOR CARRYING OUT THE INVENTION

Figure 1:
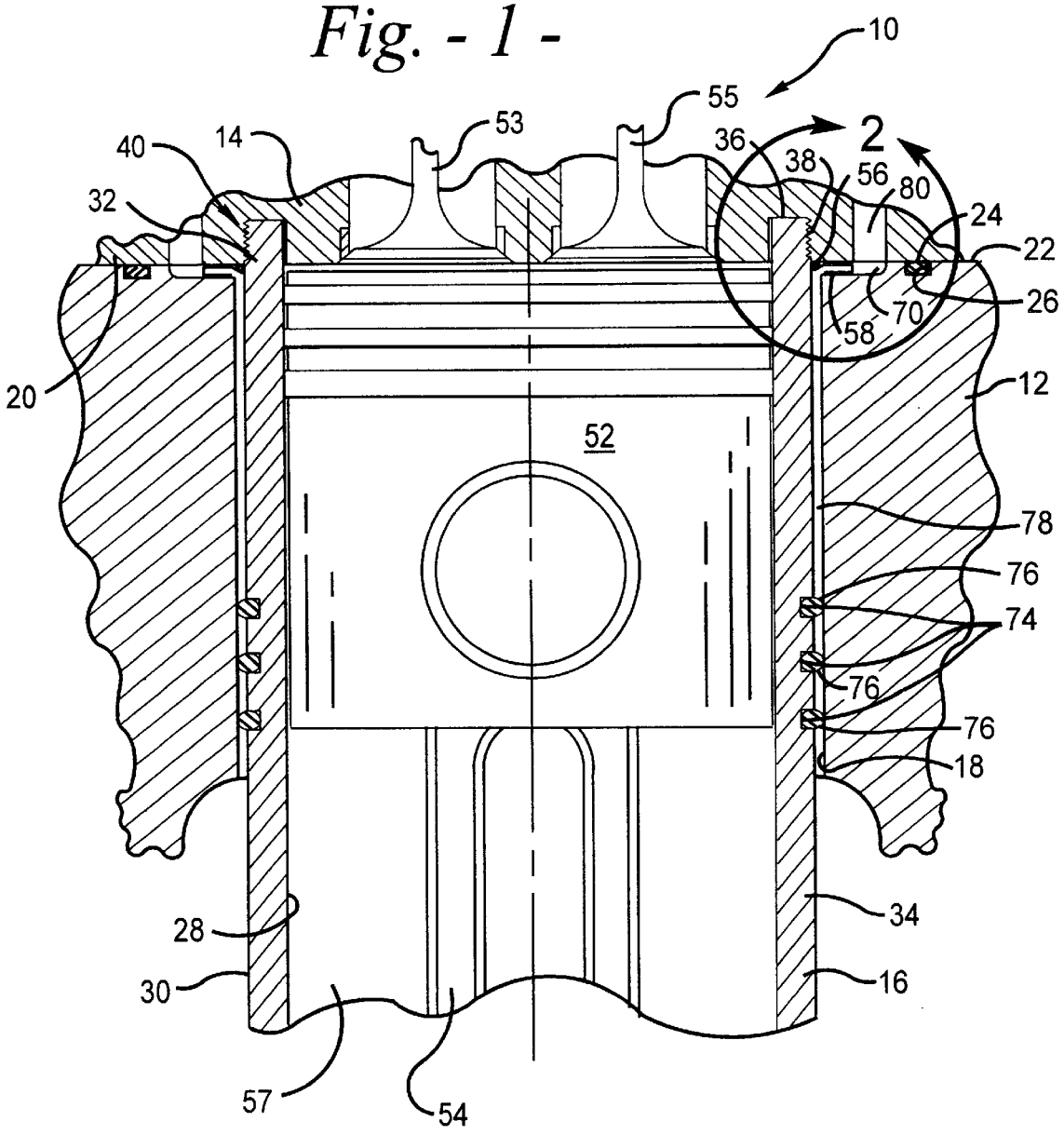
FIG. 1, is a diagrammatic cross-sectional view of a portion of an internal combustion engine showing a portion of a cylinder head, a portion of a cylinder block, a threaded cylinder liner, an elastomeric seal and ring and a piston and rod assembly disposed in the threaded cylinder liner and engine valves.

With reference to the drawings, and particularly to FIG. 1, a portion of an internal combustion engine 10 of either a diesel or a gas type is shown. The internal combustion engine 10 has an engine block 12, a cylinder head 14 and a cylinder liner 16 disposed in the cylinder receiving bore 18 of the engine block 12. The engine block 12 is cast of a suitable material such as, cast iron and the cylinder receiving bores 18 are machined in the engine block 12. Although only a single cylinder liner 16 and associated components is shown, additional cylinder liners and components may be provided.

The cylinder head 14 has a flat supporting surface 20, and the engine block 12 has a flat supporting surface 22. The cylinder head 14 is supported on the engine block 12. In the particular embodiment shown, the supporting surface 20 of the cylinder head 14 is carried in engagement with the supporting surface 22 of the engine block 12. A seal member 24, such as an "O" ring seal, is disposed in a groove 26 provided in the engine block 12. It should be recognized that other state of the art sealing techniques, for example, a head gasket or a combination gasket and seal assembly, may be utilized without departing from the spirit of the invention.

The cylinder liner 16 has spaced apart inner and outer surfaces 28,30, first and second spaced end portions 32,34 and an end surface 36 at the first end portion 34. The inner and outer surfaces 28,30 are preferably round circular cylinders. The inner and outer surfaces 28,30 are substantially parallel to each other and spaced apart a predetermined distance. The end 36 of the cylinder liner 16 is preferably perpendicular to the inner and outer surfaces 28,30. The cylinder liner 16 is made from any suitable steel material and hardened for long life. As will be seen from subsequent discussion, the liner 16 is removable for rework and replacement purposes.

Figure 2:
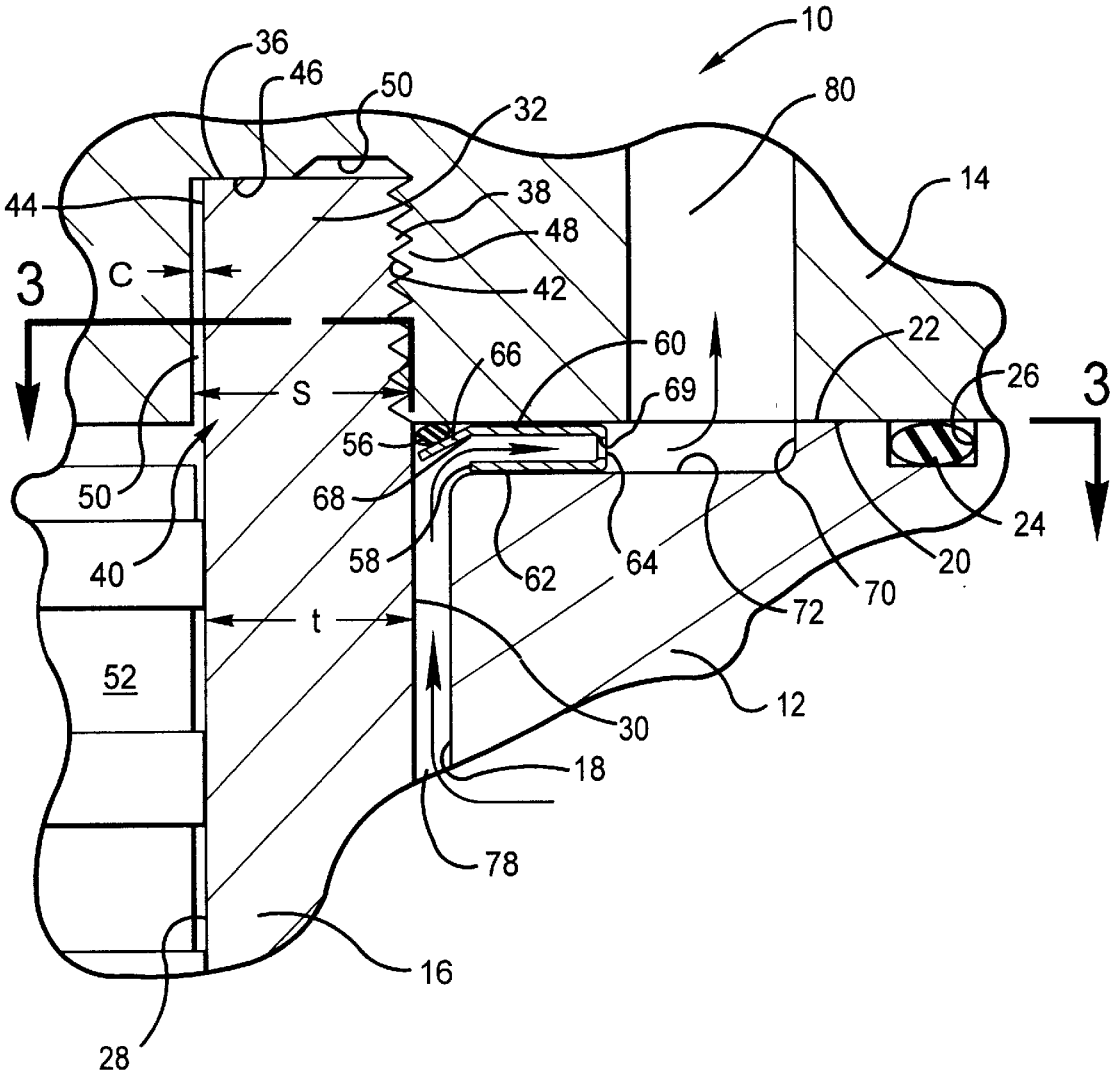
FIG. 2 is a diagrammatic enlarged detail of the threaded cylinder head and threaded liner connection taken about by detail circle 2 of FIG.1 and, FIG. 3 is a diagrammatic cross-sectional view taken along lines 3—3 of FIG. 2.

As best seen in FIG. 2, the cylinder liner 16 has an external thread 38 located at the first end portion. The external thread 38 is of the free running type and disposed about the outer surface 30. The external thread extends a preselected axial distance from the end 36 of the cylinder liner to enable bottoming out of the end 36 but limited to a length so as not to interfere with sealing and protection of the threads from coolant fluids. This will be subsequently discussed in greater detail.

Figure 3:
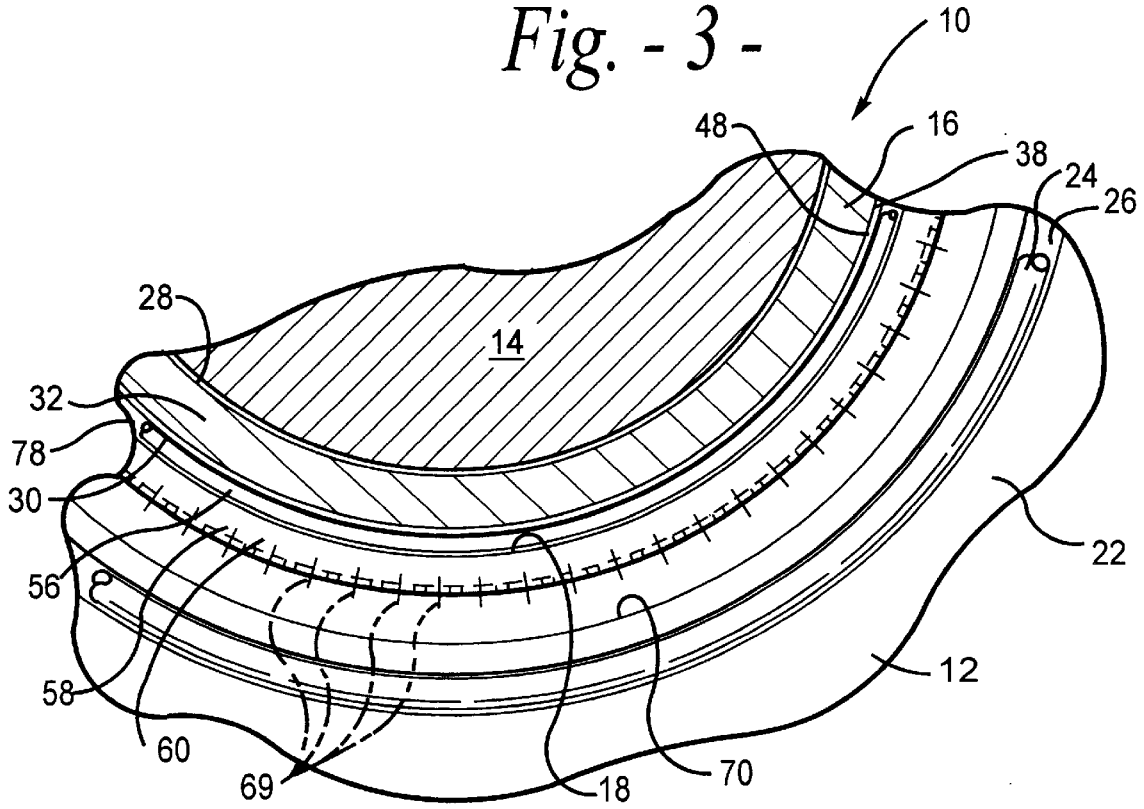

The cylinder head 14 has an annular groove 40 disposed therein which opens at the supporting surface 20 of the cylinder head 14. The annular groove 40 is blind and has a generally round circular shape (FIG.3). The annular groove 40 is defined by first and second spaced side surfaces 42,44 and an end surface 46 connected to the first and second side surfaces 42,44. The first and second side surfaces 42,44 are substantially parallel and spaced a preselected distance apart. The end surface 46 is preferably perpendicular to the side surfaces 42,44. The first side surface 42 of the annular groove 40 has screw threads 48 disposed therein. The screw threads 48 are of the free running type and terminate at the supporting surface 20 of the cylinder head 14.

An annular clearance recess 50 is disposed in the end surface 46 of the annular groove 40. The annular clearance recess 50 extends from the first side surface 42 of the annular groove 40 to a predetermined location between the first and second side surfaces 42,44 of the annular groove 40, and to a predetermined depth. The depth of the annular clearance recess 50 is sufficient to permit bottom tapping of the screw threads 48 and provide clearance at the end 36 of the cylinder liner 16 at that location.

The first end portion 32 of the cylinder liner 16 is disposed in the annular groove 40 with the screw threads 38 of the cylinder liner screwthreadably engaged with the screw threads 48 of the cylinder head 14. The end 36 of the cylinder liner 16 forcibly engaged with the end surface 46 of the annular groove 40.

The predetermined distance between the inner and outer surfaces 28,30 define a predetermined cylinder liner wall thickness "t". The wall thickness "t" is smaller in magnitude than the predetermined distance "s" between the first and second side surfaces 42,44 of the annular groove. This relationship defines a predetermined clearance distance "c" between the inner surface 28 of the cylinder liner 16 and the second side surface 44 of the annular groove 40. The clearance distance "c" is maintained at a minimum in order to reduce crevice volume and minimize engine emissions. The clearance distance "c" is within a range of between 0.0125 mm and 0.0625 mm.

The cylinder head 14, particularly, the end surface 46 of the annular groove 40 and the end 36 of the cylinder liner 16 are forced together to cause a seal between the cylinder head 14 and the cylinder liner. In particular, the force of engagement at the end 36 of the cylinder liner 16 is of a magnitude sufficient to effect side loading between the screw threads 38 of the cylinder liner and the screw threads 48 in the cylinder head 14 and cause thread sealing therebetween. This is possible because the screw threads 38 of the cylinder liner 16 and the screw threads 48 in the cylinder head 14 are free running close fit threads. The force of engagement between the end surface 46 of the cylinder head 14 and the end 36 of the cylinder liner 16 is also of a magnitude sufficient to effect sealing therebetween.

Referring to FIG.1, a piston 52 and pivotally connected piston rod 54 is disposed in a bore 57 defined by the inner surface 28 of the cylinder liner 16. The piston 52 is reciprocally movable in a conventional manner in the bore 57 between preselected axially spaced apart top and bottom dead center positions. The piston 52 when at the top dead center position is as close to the cylinder head as possible in order to minimize crevice volume. Intake and exhaust valves 53,55 are provided in the cylinder head. The valves 53,55 are exposed to a combustion chamber of the engine defined by the cylinder head 14 and bore 56 of the cylinder liner 16.

An elastomeric seal member 56 is disposed about and engaged with the outer surface 30 of the cylinder liner 16 and the supporting surface 20 of the cylinder head 14. A ring 58 is disposed between the cylinder head 14 and the engine block 12. The ring 58 is also disposed substantially concentrically about the cylinder liner 16. The ring 58 is engaged with the elastomeric seal member 56 and urges the elastomeric seal member 56 into sealing engagement with the cylinder head 14 and the outer surface 30 of the cylinder liner 16.

Referring to FIGS. 2 and 3, the ring 58 has first and second spaced side wall portions 60,62 and an end wall portion 64 connected to the first and second side wall portions 60,62. A lip portion 66 extends from an end 68 of the first side wall portion 60. The ring 58 has a plurality of spaced apart apertures 69 disposed in the end wall portion 64. The ring 58 is constructed of a steel sheet material and made, for example, by stamping or rolling.

The engine block 12 has a fluid receiving counterbore 70 disposed therein. The fluid receiving counterbore 70 is disposed about the cylinder receiving bore 18 and open at the supporting surface 22 of the engine block 12. The fluid receiving counterbore has a ring carrying surface 72 defining a predetermined depth of the fluid receiving counterbore 70 from the supporting surface 22.

The ring 58 is disposed in the fluid receiving counterbore 70 and captured between the ring carrying surface 72 and the supporting surface 20 of the cylinder head 14. As shown, the second side wall 62 is carried on the ring carrying surface 72. The lip portion 66 engages the elastomeric seal member 56 and maintains the elastomeric seal member 56 in forced fluid sealing engagement with the supporting surface 20 and the outer surface 30. This sealing at that location isolates the threads 38,48 from engine cooling fluid.

Referring to FIG. 1, a plurality of axially spaced apart annular grooves 74 are disposed circumferentially about the cylinder liner 14. The grooves 74 are spaced from the end 36 of the cylinder liner 16 a preselected distance. The grooves 74 are open at the outer surface 30. A seal member 76, such as an elastomeric "o" ring seal, is disposed in each of the grooves 74. The seal members 76 engage the bore 18 and seals the outer surface 30 relative to the cylinder receiving bore 18 of the engine block 12.

Referring to FIG.2 and 3, a first cooling fluid passing passage 78 is located in the engine block 12 between the outer surface 30 of the cylinder liner 16 and the cylinder receiving bore 18. The first cooling fluid passage 78 extends from the annular grooves 74 (seal member 76) to the supporting surface 20 of the cylinder head. The first cooling fluid passage 78 facilitates cylinder liner 16 cooling at a preselected location relative to piston operation and the combustion chamber.

A second cooling fluid passing passage 80 is disposed in the cylinder head 14. The second passage 80 opens at the cylinder head supporting surface 20. The first and second passages 78,80 both open into the fluid receiving counterbore 70. The fluid receiving counter bore 70 is open to pass cooling fluid flow between the first and second fluid passing passages 78,80. The ring being disposed in the fluid receiving counterbore 70 passes cooling fluid flow between the first and second passages 78,80 by way of the apertures 69 in the ring 58.

Referring to FIGS. 1–3, a method of assembling the cylinder liner 16 in the engine block 10 is achieved by threading the outer threaded surface 38 at the first end portion 32 of the cylinder liner 16 to the threaded annular groove 40 disposed in the cylinder head 14. The cylinder liner 16 is tightened, for example, by a spanner wrench (not shown), until the end 36 of the cylinder liner is forcibly engaged with an end surface 46 of the annular groove and the threads 38,48 are side loaded. This is achieved when a predetermined torque value is achieved during tightening. The cylinder liner 16 is then placed in the cylinder liner receiving bore 18 in the engine block 12 and the supporting surface 20 of the cylinder head 14 is placed on the supporting surface 22 of the engine block.

The elastomeric seal member 56 is positioned about the cylinder liner 16 and the ring 58 is placed in the counterbore 70 prior to placing the cylinder liner 16 in the cylinder liner receiving bore 18. Likewise, the seal members 76 are placed in the spaced apart annular grooves 74 disposed about the cylinder liner 16 prior to placing the cylinder liner 16 in the cylinder liner receiving bore 18.

Industrial Applicability

With reference to the drawings, the threaded cylinder liner 16 and threaded annular groove 40 eliminates stress risers associated with flanged cylinder liners and reduces crevice volume associated with incomplete combustion and emissions. As a result the engine runs cleaner.

During operation of the internal combustion engine 10, heat generated by the combustion process is partially transferred to the cylinder liner 16. Circulated cooling fluid flow in the first passage 78, the counterbore and in the second passage 80 cools the cylinder liner 16 at the optimum location and thereby improves cylinder liner 16 life and engine efficiency. Having coolant available to the cylinder liner 16 all the way to the head supporting surface 20 facilitates this improved cooling.

The elastomeric seal member 56 and ring 58 seals the threads 38,48 from the cooling fluid and protects the threads 38,40. This promotes ease of installation and removal of the cylinder liner 16. Also, the elastomeric seal 56 and ring 58 as constructed is easy to install and remove.

The liner having free running, close fit threads, facilitates sealing and reduces the potential for combustion chamber leakage. The cylinder liner 16 being threaded externally on the outer surface 30 and having a round circular cylinder shape reduces the cost of manufacture.

Other aspects, objects and advantages of this invention can be obtained from a study of the drawings, the disclosure and the appended claims.

I claim:

1. A connecting arrangement for a cylinder liner of and internal combustion engine; comprising:

a cylinder liner having an outer surface, an inner surface, first and second spaced end portions and an end located at the first end portion;

a screw thread disposed in and about the outer surface of the first end portion of the cylinder liner and terminating at the first end;

a cylinder head having a supporting surface and an annular groove disposed in said cylinder head and opening at said supporting surface, said annular groove being defined by a first side surface, a second side surface spaced from said first side surface and an end surface, said first side surface having screw threads disposed therein and terminating at the supporting surface of said cylinder head, said first end portion of the cylinder liner being disposed in the annular groove, said screw threads of the cylinder liner being threadably engaged with the screw threads in the cylinder head, and said end of the cylinder liner being forcibly engaged with the end surface of the annular groove.

2. A connecting arrangement, as set forth in claim 1, wherein the first and second side surfaces of the annular groove are spaced a predetermined distance apart, and said inner and outer surfaces of the said cylinder liner are spaced a predetermined distance apart and define a predetermined cylinder liner wall thickness, said wall thickness being smaller in magnitude than the distance between the first and second side surfaces of the annular groove and defining a predetermined clearance distance between the inner surface of the cylinder liner and the second side surface of the annular groove.

3. A connecting arrangement, as set forth in claim 2, wherein said clearance distance between the inner surface of the cylinder liner and the second side surface of the annular groove being minimal and having a magnitude within a range of between 0.0125 mm and 0.0625 mm.

4. A connecting arrangement, as set forth in claim 2 wherein said cylinder liner inner and outer surfaces being round circular cylindrical surfaces.

5. A connecting arrangement, as set forth in claim 4, wherein said end of the cylinder liner being substantially perpendicular to the inner and outer surfaces.

6. A connecting arrangement, as set forth in claim 2, wherein said end surface of the annular groove connecting the first and second spaced side surfaces of the annular groove and including an annular clearance recess disposed in the end surface of the annular groove, said annular clearance recess extending from the first side surface of the annular groove to a predetermined location between the first and second side surfaces of the annular groove and to a predetermined depth, said annular clearance recess providing clearance at the end of the cylinder.

7. A connecting arrangement, as set forth in claim 5 wherein the end surface of the annular groove being substantially perpendicular to the first and second side surfaces of the annular groove.

8. A connecting arrangement, as set forth in claim 2, wherein said force of engagement between the cylinder head and the end of the cylinder liner being of a magnitude sufficient to effect side loading between the screw threads of the cylinder liner and the screw threads in the cylinder head and thread sealing therebetween.

9. A connecting arrangement, as set forth in claim 8, wherein the force of engagement between the cylinder head and the end of the cylinder liner is of a magnitude sufficient to effect sealing therebetween.

10. A connecting arrangement, as set forth in claim 8, wherein said screw threads of the cylinder liner and the screw threads in the cylinder head are free running close fit threads.

11. A connecting arrangement, as set forth in claim 1, including:

an engine block having a cylinder receiving bore and a supporting surface, said cylinder being disposed in the cylinder receiving bore, and said engine block supporting surface being supportingly engaged with said supporting surface of the cylinder head;

an elastomeric seal member disposed about and engaged with the outer surface of the cylinder liner, said elastomeric seal member being engaged with the supporting surface of the cylinder head; and a ring disposed between the cylinder head and the engine block and about the cylinder liner, said ring being engaged with the elastomeric seal member and urging the elastomeric seal member into sealing engagement with the cylinder head and the outer surface of the cylinder liner.

12. A connecting arrangement, as set forth in claim 11, wherein said ring has first and second spaced side wall portions, an end wall portion connected to the first and second side wall portions, and a lip portion extending from an end of the first side wall portion, said lip portion being engaged with the elastomeric seal member.

13. A connecting arrangement, as set forth in claim 12, including:

a first cooling fluid passing passage defined between the outer surface of the cylinder liner and the bore of the engine block;

a second cooling fluid passing passage disposed in the cylinder head and opening at the cylinder head supporting surface; and a fluid receiving counter bore disposed in the engine block about the cylinder receiving bore, said counter bore being open to pass cooling fluid flow between the first an second fluid passing passages, said ring having a plurality of spaced apart apertures disposed in the end wall portion, said ring being disposed in the counterbore and passing cooling fluid flow between the first and second passages by way of the plurality of apertures.

14. A connecting arrangement, as set forth in claim 13, wherein said counterbore having an end and said second side wall portion being engaged with the end of the counterbore and maintaining the elastomeric seal member in forced engagement with the cylinder head and the outer surface of the cylinder liner.

15. A connecting arrangement, as set forth in claim 13, including:

a plurality of axially spaced annular groves disposed circumferentially about the cylinder liner and opening at the outer surface;

a seal member disposed in the annular grooves and sealingly engaged with the engine block bore.

16. A method of assembling a cylinder liner in an engine block, comprising the steps of:

screw threading a cylinder liner having an externally threaded first end portion into a threaded annular groove disposed in a cylinder head;

tightening the cylinder liner until an end of the cylinder liner is forcibly engaged with an end surface of the annular groove and the threads are side loaded;

placing the cylinder liner in a cylinder liner receiving bore disposed in an engine block;

supporting a supporting surface of the cylinder head on a supporting surface of the engine block.

17. A method, as set forth in claim 16, including the step of placing an elastomeric seal member about the cylinder liner prior to placing the cylinder liner in the cylinder liner receiving bore.

18. A method, as set forth in claim 17, including the step of placing a ring in a counterbore disposed in the engine block prior to placing the cylinder liner in the cylinder liner receiving bore.

19. A method, as set forth in claim 18, including the step of placing a plurality of seal members in spaced apart annular grooves disposed about the cylinder liner prior to placing the cylinder liner in the in the cylinder liner receiving bore.

20. A method, as set forth in claim 16, including the step of tightening the cylinder liner to a predetermined torque value.

* * * * *